US005856808A

United States Patent [19]

Holshouser et al.

[11] Patent Number: 5,856,808

[45] Date of Patent: Jan. 5, 1999

[54] SINGLE FEED POINT MATCHING SYSTEMS

[75] Inventors: Howard E. Holshouser, Efland; Robert A. Sadler, Durham; Gerard Hayes, Wake Forest; John W. Gammon, Raleigh, all of N.C.

[73] Assignee: Ericsson Inc., Research Triangle Park, N.C.

[21] Appl. No.: 939,395

[22] Filed: Sep. 29, 1997

[51] Int. Cl.[6] ..... H01Q 1/24

[52] U.S. Cl. ..... 343/702; 343/901; 343/895

[58] Field of Search ..... 343/702, 900, 343/901, 906, 895, 850; H01Q 1/24

[56] References Cited

U.S. PATENT DOCUMENTS

| | | | |
|---|---|---|---|
| 5,317,325 | 5/1994 | Bottomley | 343/702 |
| 5,374,937 | 12/1994 | Tsunekawa et al. | 343/702 |
| 5,467,096 | 11/1995 | Takamoro et al. | 343/702 |
| 5,583,519 | 12/1996 | Koike | 343/702 |
| 5,691,730 | 11/1997 | Egashira et al. | 343/702 |

*Primary Examiner*—Hoanganh Le

*Attorney, Agent, or Firm*—Myers Bigel Sibley & Sajovec

[57] ABSTRACT

Single feed point matching systems for radiotelephones include a retractable antenna and a stationary ferrule contact which are configured to define a coaxial capacitor therebetween when the antenna is in the extended position.

26 Claims, 9 Drawing Sheets

100
120
115
125
117

100
115
15
17
117

GROUND
SIGNAL
SHUNT CONTACT

RETRACTED 20
27
25
30
115
75
40
28a
C12b
15
29
14
17
117

SINGLE FEED POINT MATCHING SYSTEMS

FIELD OF THE INVENTION

The present invention relates to telephones, and more particularly relates to matching systems used in telephones with retractable antennas.

BACKGROUND OF THE INVENTION

Many radiotelephones employ retractable antennas, i.e., antennas which are extendable and retractable out of the radiotelephone housing. The retractable antennas are electrically connected to a signal processing circuit positioned on an internally disposed printed circuit board. In order to optimally operate, the signal processing circuit and the antenna should be interconnected such that the respective impedances are substantially "matched", i.e., electrically tuned to filter out or compensate for undesired antenna impedance components to provide a 50 Ohm impedance at the circuit feed. Unfortunately, complicating such a matching system, a retractable antenna by its very nature has dynamic components, i.e., components which move or translate with respect to the housing and the printed circuit board and as such does not generally have a single impedance value. Instead, the retractable antenna typically generates largely different impedance values when in an extended versus a retracted position. Therefore, it is preferred that the impedance matching system alters the antenna's impedance to properly match the terminal's impedance both when the antenna is retracted and extended.

The physical configuration of the matching network is further complicated by the miniaturization of the radiotelephone and the internally disposed printed circuit board. Many of the more popular handheld telephones are undergoing miniaturization. Indeed, many of the contemporary models are only 11–12 centimeters in length. Because the printed circuit board is disposed inside the radiotelephone, its size is also shrinking, corresponding to the miniaturization of the portable radiotelephone. Unfortunately, as the printed circuit board decreases in size, the amount of space which is available to support desired operational and performance parameters of the radiotelephone is generally correspondingly reduced. Therefore, it is desirable to utilize efficiently and effectively the limited space in the radiotelephone and on the printed circuit board.

This miniaturization can also create complex mechanical and electrical connections with other components such as the outwardly extending retractable antenna which must generally interconnect with the housing for mechanical support, and, as discussed above, to an impedance matching system operably associated with the printed circuit board in order for the signal to be processed.

As is well known to those of skill in the art, retractable antennas typically include desired matching circuits, one associated with the extended position and one with the retracted position. In the extended position, the antenna typically operates with a half-wave ($\lambda/2$) load. In this situation, the associated impedance may rise as high as 600 Ohms. In contrast, in the retracted position, the antenna rod generally operates with a quarter-wave ($\lambda/4$) load with an impedance typically near 50 Ohms. Therefore, when the antenna is in the extended position an L-C matching circuit may be needed or desired to match out the additional impedance.

In the past, conventional portable radiotelephones have used a variety of antenna connections to switch matching system into the circuit corresponding to the position of the antenna in order to the electrically connect the system with the antenna and the printed circuit board or signal processor. For example, U.S. Pat. No. 5,374,937 to Tsunekawa et al. proposes downwardly spaced-apart contacts or terminals on the printed circuit board in the radiotelephone housing which act to engage with or short out the associated matching network. Unfortunately and disadvantageously, this type of switching connection can employ a number of discrete switching components such as wiping contacts with multiple signal feed points and additionally may use an undesirable amount of space on the printed circuit board.

One alternative is described in a co-pending patent application, Ser. #08/858,982, filed May 20, 1997, entitled "Radiotelephones with Antenna Matching Switching System Configurations" by Gerard J. Hayes and Howard E. Holshouser. This system employs transversely spaced-apart circuit and antenna contacts to reduce the amount of space on the printed circuit board needed to operate the matching system. An additional alternative is described in a co-pending application, Ser. #08/841,193, filed Apr. 29, 1997, entitled "Radiotelephones with Integrated Antenna Matching Systems" by Howard E. Holshouser. Each of these references is hereby incorporated by reference as if recited in full herein.

OBJECTS AND SUMMARY OF THE INVENTION

It is therefore a first object of the present invention to provide an antenna with a single feed point which can engage a matching system for radiotelephones with retractable antennas in a manner which minimizes degradation in antenna performance.

It is yet another object of the present invention to provide an economical retractable antenna assembly with a single feed point.

It is a further object of the present invention to provide a retractable antenna assembly with a matching system which is automatically switched to a desired signal path corresponding to the physical retraction and extension of the antenna.

These and other objects are satisfied by the present invention by an antenna assembly which employs a single stationary signal feed point and which uses the inherent capacitive characteristics of the antenna in a matching network. In particular, a first aspect of the invention includes an antenna assembly which comprises a cylindrical antenna having a conductive core and an outer surface and including opposing first and second ends defining a central axis through the center thereof. The antenna includes upper and lower contacts in electrical communication with the core which are positioned on the outer surface of the antenna. The assembly also includes a non-conductive base unit having top and bottom ends and including an aperture therethrough. The aperture is configured to receive portions of the antenna therein. The base unit includes a conductive ferrule fixedly attached to and extending from the bottom of the base unit. The antenna retracts and extends in and out of the base unit such that when the antenna is retracted the antenna upper contact electrically contacts the ferrule and when the antenna is extended the ferrule and the antenna define a capacitor therebetween. Preferably, the base unit aperture extends along the central axis of the antenna and the antenna translates in and out of the base unit along the central axis and the ferrule is configured as a cylindrical conductor. It is also preferred that the antenna outer surface adjacent the lower contact include an insulating barrier.

In a preferred embodiment, the antenna assembly is included in a radiotelephone which includes an internally disposed printed circuit board and an antenna connector affixed to the printed circuit board. The antenna connector includes separate ground and signal contacts thereon such that the ferrule engages with the signal contact to provide a single signal feedpoint to transmit and receive an RF signal to and from the antenna and the radiotelephone.

Advantageously, the present invention configures the antenna, the ferrule, and the antenna connector to define first and second signal paths which are automatically switched corresponding to the translation of the antenna. In particular, the first signal path is operative when the antenna is extended and the second signal path is operative when the antenna is retracted. Further, the instant invention uses the inherent capacitive characteristics of the antenna rod as part of the matching circuit.

Another aspect of the present invention is a radiotelephone with a matching system. The radiotelephone includes a radiotelephone housing, a printed circuit board disposed in the housing, and an antenna connector secured to the housing. The antenna connector comprises first and second contacts. The radiotelephone also includes an antenna base having an opening therein attached to the radiotelephone housing. The antenna base includes a portion which extends out of the radiotelephone and a portion which is contained within the radiotelephone. The portion which is contained within the housing includes a contact ferrule thereon. The radiotelephone also includes a longitudinally extending antenna adapted to be received in the antenna base opening such that the antenna is free to retract and extend relative thereto. The antenna includes upper and lower electrical contacts. When the antenna is retracted the upper contact electrically communicates with the contact ferrule and the first antenna connector contact to define a first signal path. When the antenna is extended the lower contact is spaced apart from the contact ferrule and the lower contact and the contact ferrule electrically communicate with its respective second and first contact to provide a matching L-C circuit. Advantageously, the capacitor in the L-C circuit is defined by the contact ferrule and the antenna in the retracted position.

Yet another aspect of the present invention is similar to those described above, but is directed towards a matching system for a radiotelephone.

Advantageously, the present invention configures the antenna, the ferrule, and the antenna connector to define first and second signal paths which are automatically switched corresponding to the translation of the antenna. In particular, the first signal path is operative when the antenna is extended and the second signal path is operative when the antenna is retracted. Further, the instant invention uses the inherent capacitive characteristics of the antenna rod as part of the matching circuit and employs a single feed point which minimizes the amount of space inside the radiotelephone (and on the printed circuit board) needed to switch and match the impedance of the antenna.

The foregoing and other objects and aspects of the present invention are explained in detail in the specification set forth below.

DESCRIPTION OF PREFERRED EMBODIMENTS

The present invention will now be described more fully hereinafter with reference to the accompanying figures, in which preferred embodiments of the invention are shown. This invention may, however, be embodied in many different forms and should not be construed as limited to the embodiments set forth herein. Like numbers refer to like elements throughout. Layers may be exaggerated for clarity.

Figure 1:
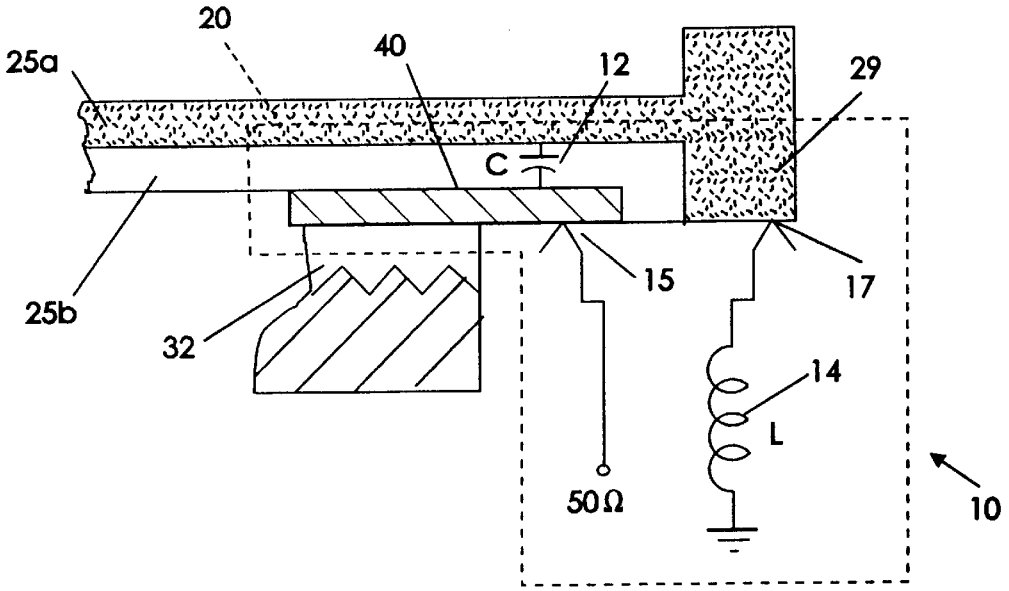
FIG. 1 is a schematic representation of a preferred embodiment of a matching system according to the present invention.
Figure 6:
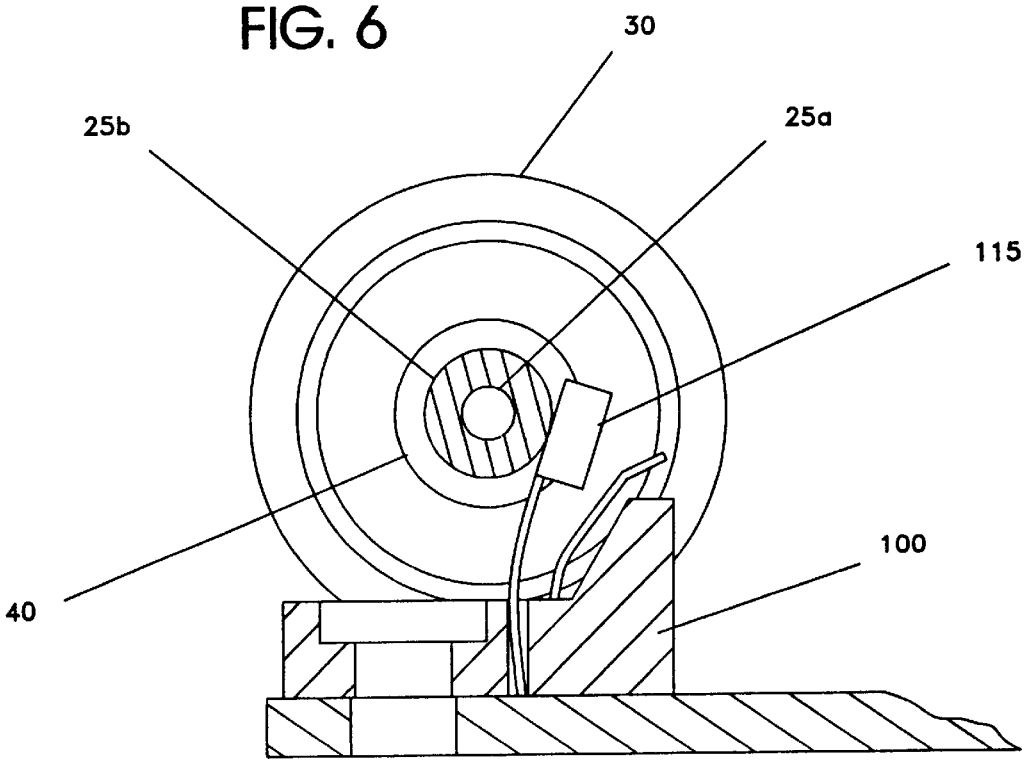
FIG. 6 is a sectional end view taken along the line 6—6 in FIG. 5.
Figure 4:
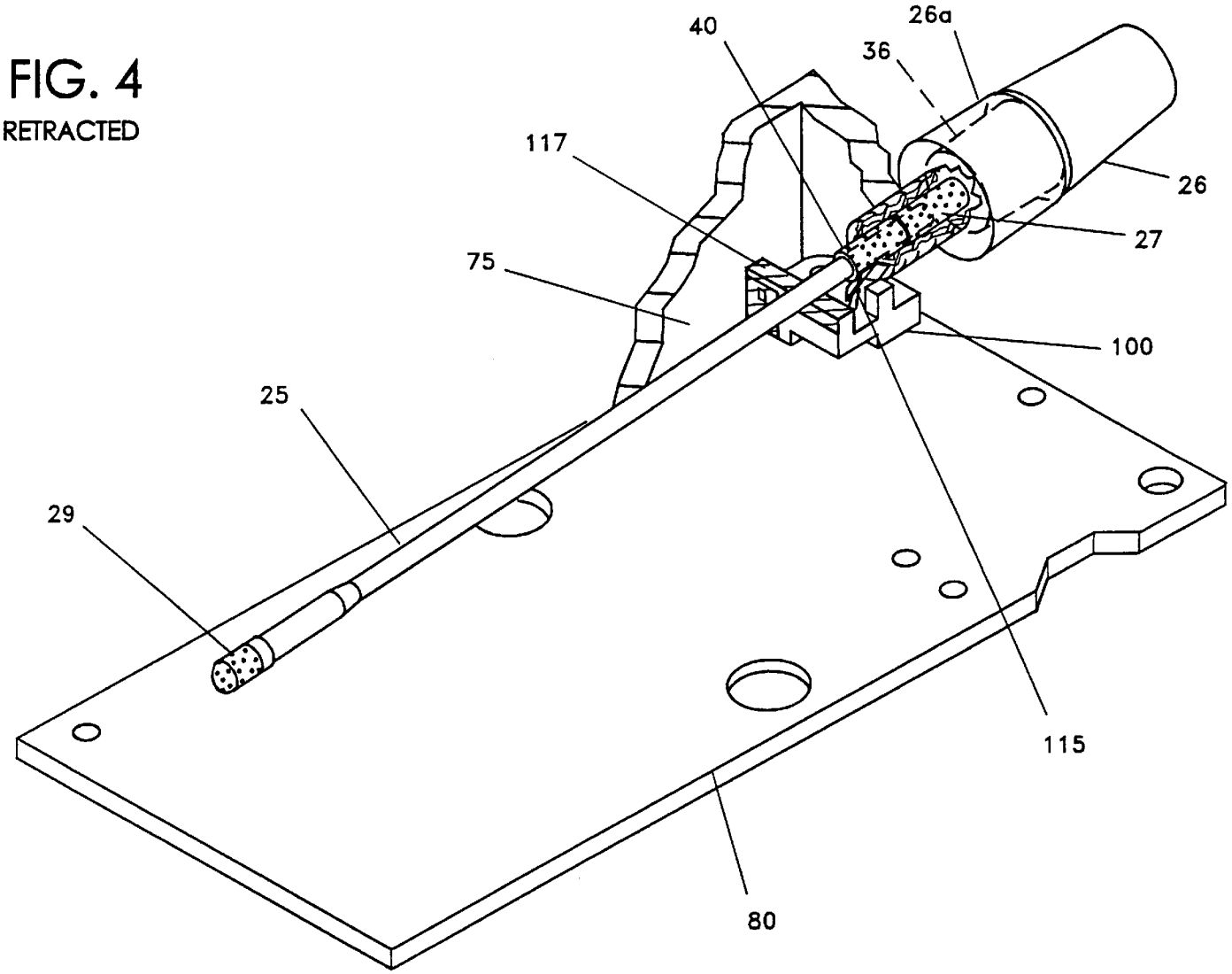
FIG. 4 is a partial cutaway perspective view of a radiotelephone with a retractable antenna in the retracted position according to the present invention.

Generally described, as schematically illustrated in FIG. 1, when the antenna 20 is extended out of the radiotelephone, the present invention provides a matching network 10 which includes a capacitor 12 and an inductor 14 in a circuit path which is electrically connected to a single signal feed contact 15. Advantageously, as shown, the capacitor 12 is formed as a coaxial capacitor defined by the antenna 20 and contact ferrule 40. The inductor 14 is included in the circuit path by electrical contact 17 with a lower conductive contact 29 positioned on the end of the antenna rod 25. Thus, the instant invention, recognizing that the antenna rod 25 (with a conductive core 25*a* and non-conductive outer surface 25*b*) can have inherent capacitive characteristics which can produce undesirable affects in conventional matching networks, harnesses those capacitive characteristics and includes them as a capacitive element in a matching network 10. Preferably, the radiotelephone includes a single feed point 15 such that the signal path preferably operates with a 50 Ohm impedance in both the extended and retracted positions (matching the increased impedance in the extended position) and is operably associated with the printed circuit board in the radiotelephone. This RF feed 15 is electrically connected with the printed circuit board 80 or other substrate which processes the radiotelephone signal (FIG. 4).

Figure 2:
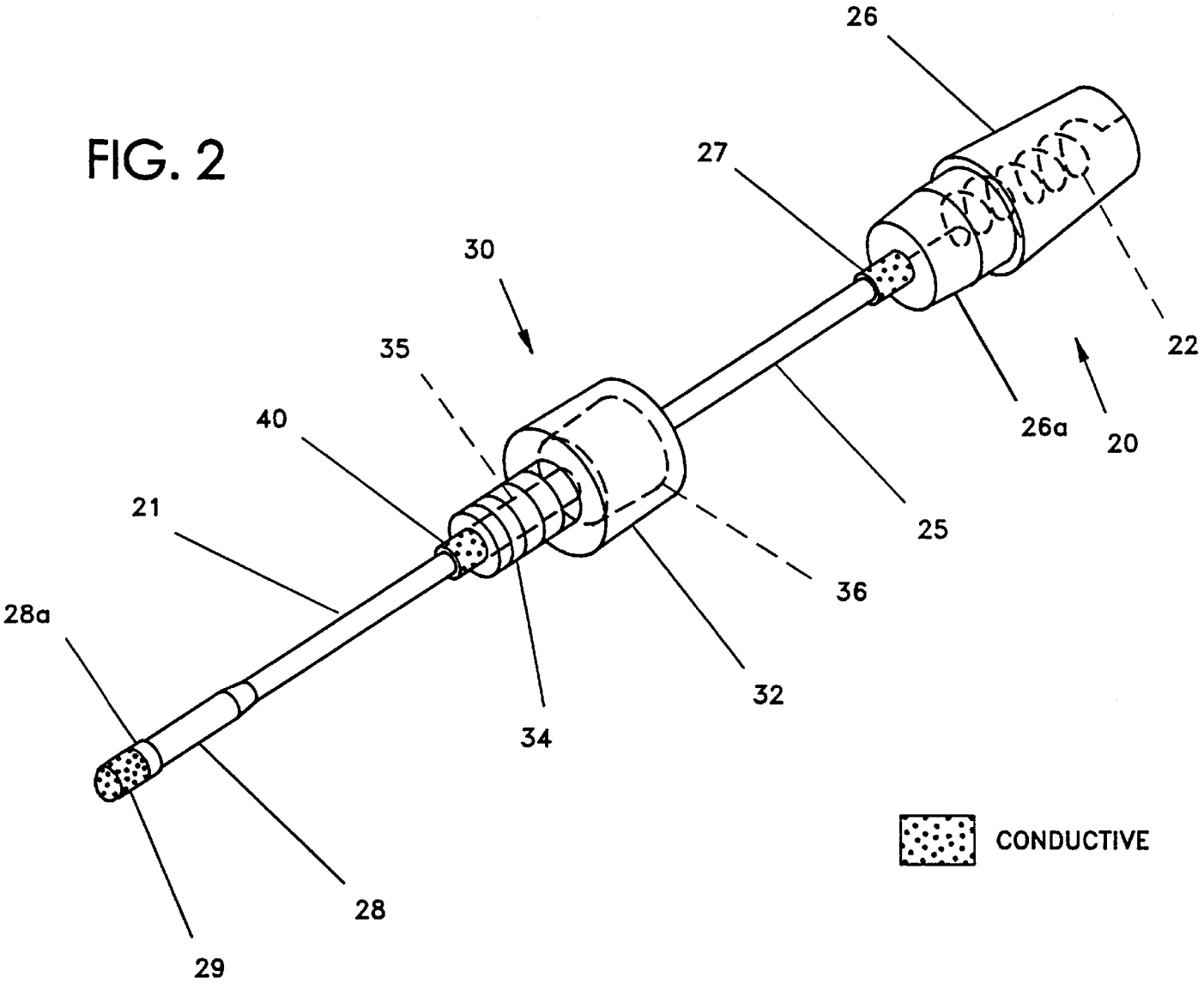
FIG. 2 is a perspective view of a retractable antenna and associated base unit according to the present invention.
Figure 7A:
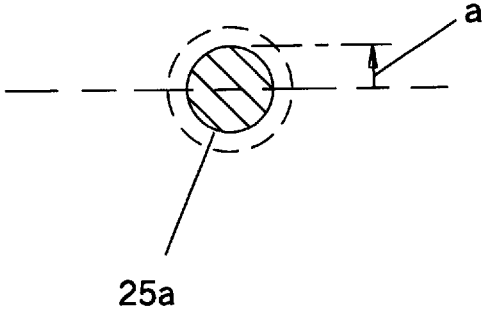
FIG. 7A is a sectional view of the antenna shown in FIG. 7 illustrating the radius of the core (a) of the antenna rod.

FIG. 2 illustrates a preferred embodiment of an antenna 20 and associated base unit 30. The antenna 20 includes a linear rod 25 and a top loaded element 22 such as a helical coil positioned in an end cap 26. The antenna outer surface 21 is non-conductive except for upper and lower contacts 27, 29 positioned on the linear rod. The linear rod has an internal conductive core 25*a* (FIG. 7A). The top element 22, the core 25*a*, and the upper and lower contacts 27, 29 are in electrical communication. Preferably, the antenna core 25*a* is cylindrical with a predetermined radius (a), as will be discussed further below. The end cap 26 is preferably configured with a lower extending portion 26*a* intermediate of the linear element and the top element 22. The lower portion of the antenna 20 preferably includes an enlarged portion 28 adjacent the lower contact 29. As will be discussed further below, the enlarged portion 28 is configured to provide an insulating barrier between the feed point 15 and the electrical contact 17 when the antenna 20 is extended to separate the signal and shunt inductor path and provide a matching circuit 10. As is well known to those of skill in the art the antenna can be alternatively configured. Thus, although described as a top loaded monopole that operates as a half wave in the extended position and a quarter wave stub (helical spiral) in the retracted position, the invention is not limited to this antenna load or configuration as alternative antenna configurations can also be employed in the instant invention. For example, an antenna load which has an integer multiple of a half-wave length, or a coil, disc or other type antenna load element.

Preferably, the electrical length of the antenna 20 (typically defined by the top load element 22 and the length of the linear rod 25) is predetermined. Further preferably, the electrical length of the antenna 20 is configured to provide a half wavelength or an integer multiple of a half wavelength so that the antenna 20 resonates with the operation frequency.

As shown in FIG. 2, the base unit 30 includes an opening 35 formed through the center thereof. The opening 35 is sized and configured to allow the antenna 20 to translate (extend and retract) therethrough. Preferably, the upper portion 32 of the base unit 30 is configured as a receiving aperture 36 for receiving a lower end portion of the end cap 26 therein when the antenna 20 is in the retracted position (FIG. 4). In this embodiment, the contact ferrule 40 is positioned in the bottom of the base unit 30 such that it aligns with the central axis 50 (the axis defined by a line extending between the opposing ends of the base unit 30) (FIG. 7A). Preferably, the contact ferrule 40 is a cylindrical contact which extends out the bottom of the base unit 30. Preferably, the base unit is non-conductive except for the contact ferrule 40. However, the base unit 30 can also include electrically conductive portions such as electrical traces (not shown) disposed along the inner surface of the opening 35 so as to facilitate electrical contact between the antenna upper contact 27 and the contact ferrule 40 when the antenna 20 is in the retracted position. In any event, the base unit 30 is configured to be assembled to a radiotelephone housing 75 (FIG. 4). Preferably, the base unit includes a threaded portion 34 for easy attachment to existing inserts in many radiotelephones.

Figure 5:
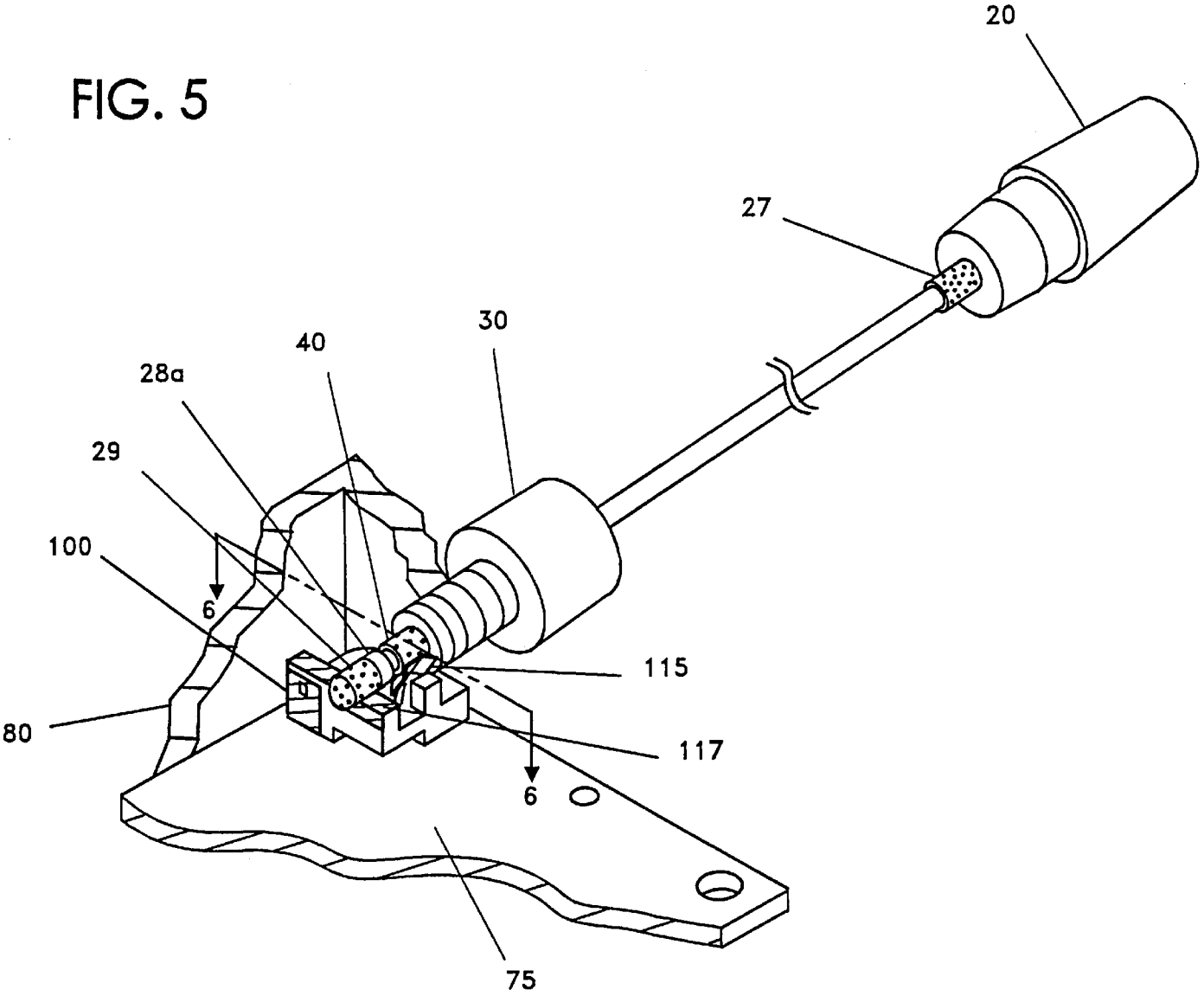
FIG. 5 is a side perspective view of a retractable antenna in the extended position positioned in a radiotelephone according to the present invention.

As illustrated by FIGS. 4 and 5, it will be appreciated that when the antenna 20 is extended, a major portion of the body is outside of the housing 75; in contrast, when the antenna 20 is retracted, a major portion of the antenna 20 is positioned inside the radiotelephone housing 75. In operation, the antenna rod 25 extends in and out of the housing passage 30 (FIG. 7) along the central axis 50 and engages with the housing 75 such that different circuit paths are defined and activated by the position of the antenna 20 within the antenna base unit 30 corresponding to the retraction and extension of the antenna as will be discussed in more detail hereinbelow. The radiotelephone also includes a radiotelephone printed circuit board 80 disposed in the housing adjacent the antenna to connect the signal or RF feed from the antenna into and out of the radiotelephone. As will be appreciated by those of skill in the art, the printed circuit board 80 is configured to receive (and transmit) an electrical signal via the antenna 20 through a single feed point 15.

Figures 3, 3A:
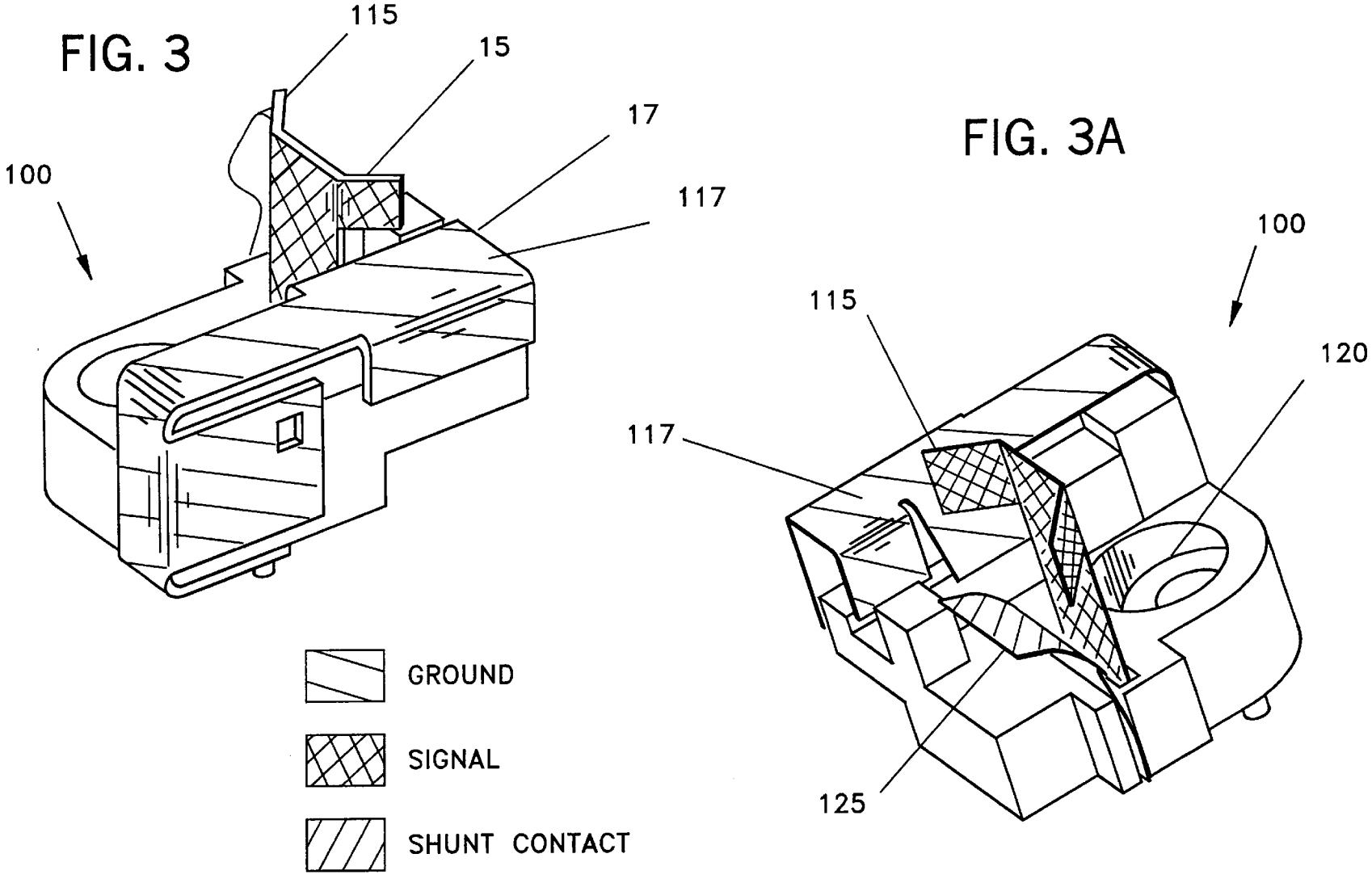
FIG. 3 is a side perspective view of an antenna connector according to the present invention.
FIG. 3A is a perspective view of another side of the connector in FIG. 3.

Turning now to FIGS. 3 and 3A, which illustrate a preferred embodiment of an antenna connector 100. As shown, the antenna connector 100 includes a first conductive contact 115 and an electrically separate second conductive contact 117. The first contact 115 forms the single signal feed 15 and the second conductive contact 117 forms the inductor contact 17 of the matching circuit when the antenna 20 is extended. As illustrated by FIGS. 4 and 5, the first contact 115 is configured to electrically and mechanically engage with the contact ferrule 40 both when the antenna is extended and retracted to provide a single signal feed point 15. In contrast, the second contact 117 is configured to engage the lower contact 29 of the antenna 20 when the antenna 20 is extended . When retracted, the second contact 117 is electrically inactive as it contacts only non-conducting surfaces of the antenna 20. Optionally, as shown in FIG. 4*a*, the lower contact engages with an internal ground 127.

Preferably, the first contact 115 is an upwardly extending spring contact which is spatially separated apart from the planar surface second contact 117. The connector 100 can also include a ground contact 125 which can be used for factory testing .

The connector is secured to the printed circuit board 80 so that the corresponding traces on the substrate align with the signal and ground paths in the connector. Preferably, as shown, the connector 100 includes a counterbored opening 120. A threaded member such as a screw can be recessed into the opening 120 and into the printed circuit board 80 in the radiotelephone housing 75.

Figure 4A:
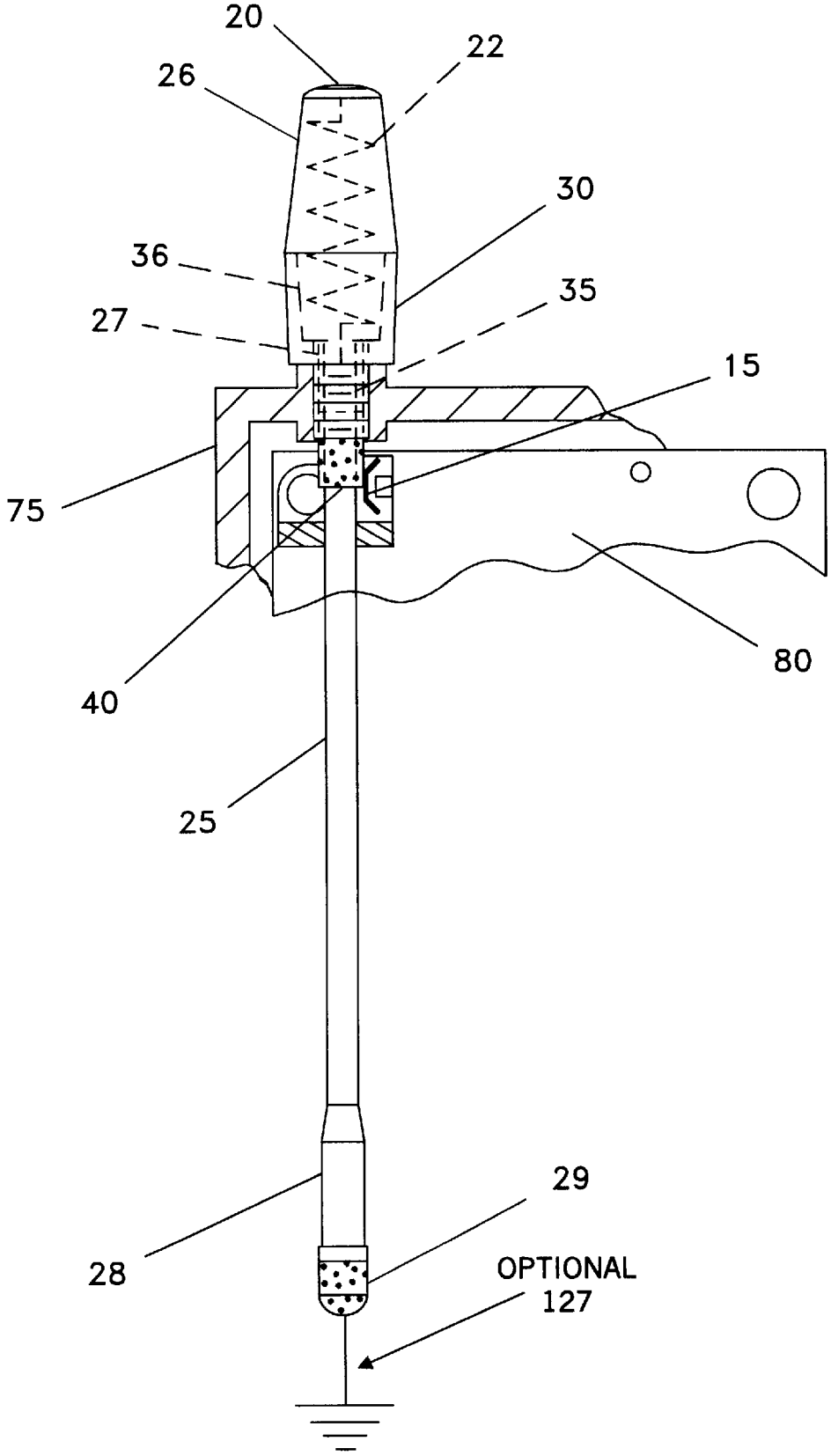
FIG. 4A is a top perspective view of the radiotelephone shown in FIG. 4.

FIGS. 4 and 4A illustrate the antenna 20 in the retracted position. As shown, the lower portion of the end cap 26*a* is received into the antenna base aperture 36. Preferably, the lower portion of the end cap 26*a* and the aperture 36 are configured to snap into position when properly retracted. The linear antenna rod 25 extends through the opening in the base unit 35. The antenna upper contact 27 is in electrical communication with the contact ferrule 40 and the contact ferrule 40 is electrically engaged with the first connector contact 115 (the signal feed 15). Thus, the top element 22, which is electrically connected to the upper contact 27, is directly input into the signal feed 15, bypassing the lower linear rod 25 element portion of the antenna (thus preferably providing a $\lambda/4$ wavelength antenna). In this position, the second connector contact 117 contacts only the non-conducting outer surface 25*b* of the antenna and is therefore electrically inactive. Preferably, an outer surface of the upper contact 27 (such as a side or end) physically contacts the contact ferrule 40. However, the upper contact 27 can also electrically communicate with the contact ferrule 40 via contact channels or the like positioned intermediate of the upper contact 27 and contact ferrule 40 (not shown). The end of the antenna rod may optionally be grounded. This optional ground can be provided as a connector on the printed circuit board disposed further into the phone.

Figure 5A:
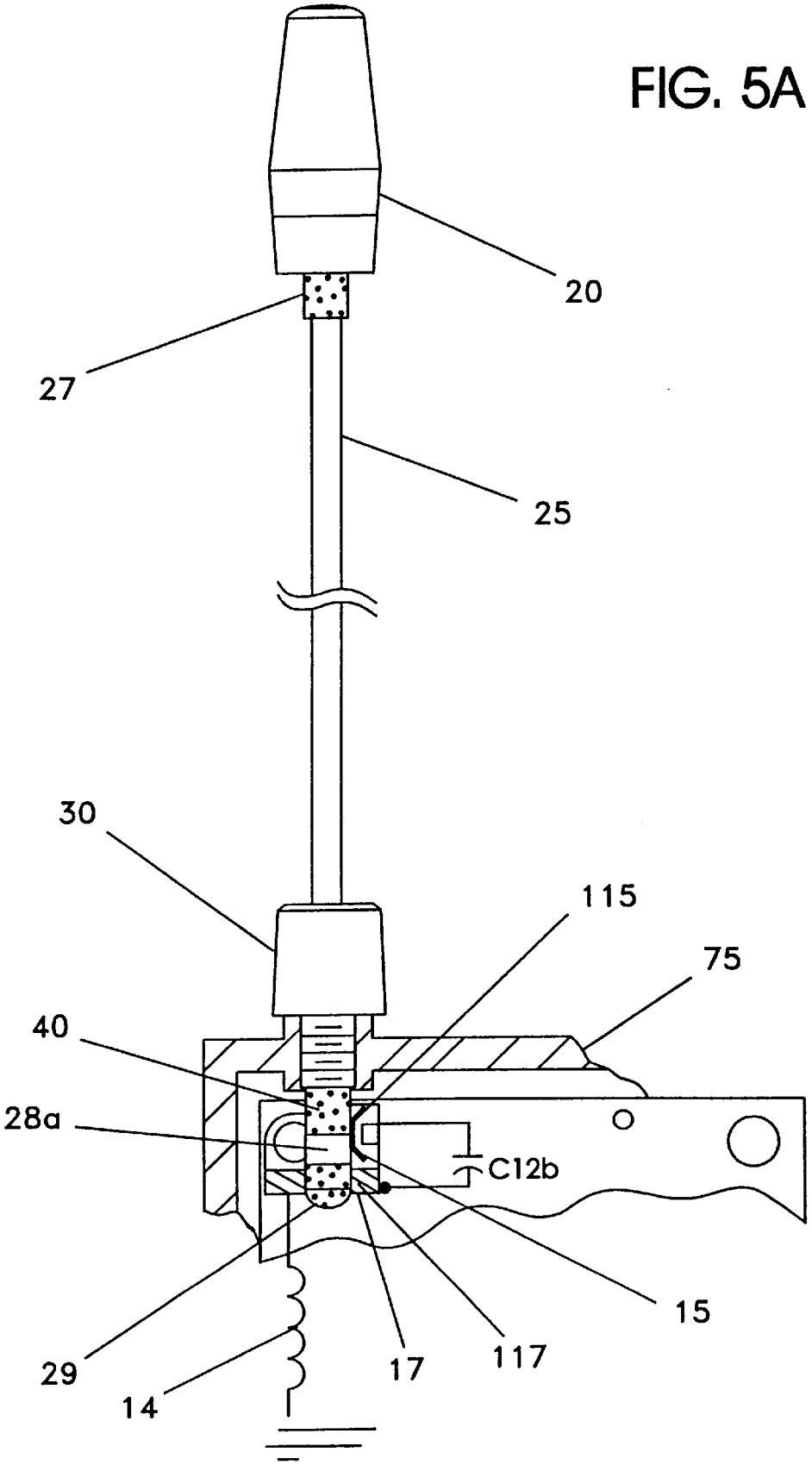
FIG. 5A is a top perspective view of the radiotelephone shown in FIG. 5.

In contrast, in the extended position as shown by FIGS. 5 and 5A, the antenna upper contact 27 is longitudinally extended out of the radiotelephone housing 75 and away from the contact ferrule 40. Instead, the contact ferrule 40 is positioned adjacent a linear rod 25 portion of the antenna to provide the capacitor 12 in a matching circuit 10 as described in FIG. 1 above. Optionally, as shown, an additional capacitor 12*b* can be added to supplement the capacitor 12 as shown in FIG. 5A. The lower contact 29 engages with the second contact 117 to engage the inductor contact 17 and an associated shunt inductor 14 in the matching circuit. Preferably, a barrier 28*a* provides an insulating electrical and spatial buffer between the signal feed 15 and the inductor path 17 to help assure proper circuit operation. A typical inductor is sized between about 6 and 8 mH.

Figure 7:
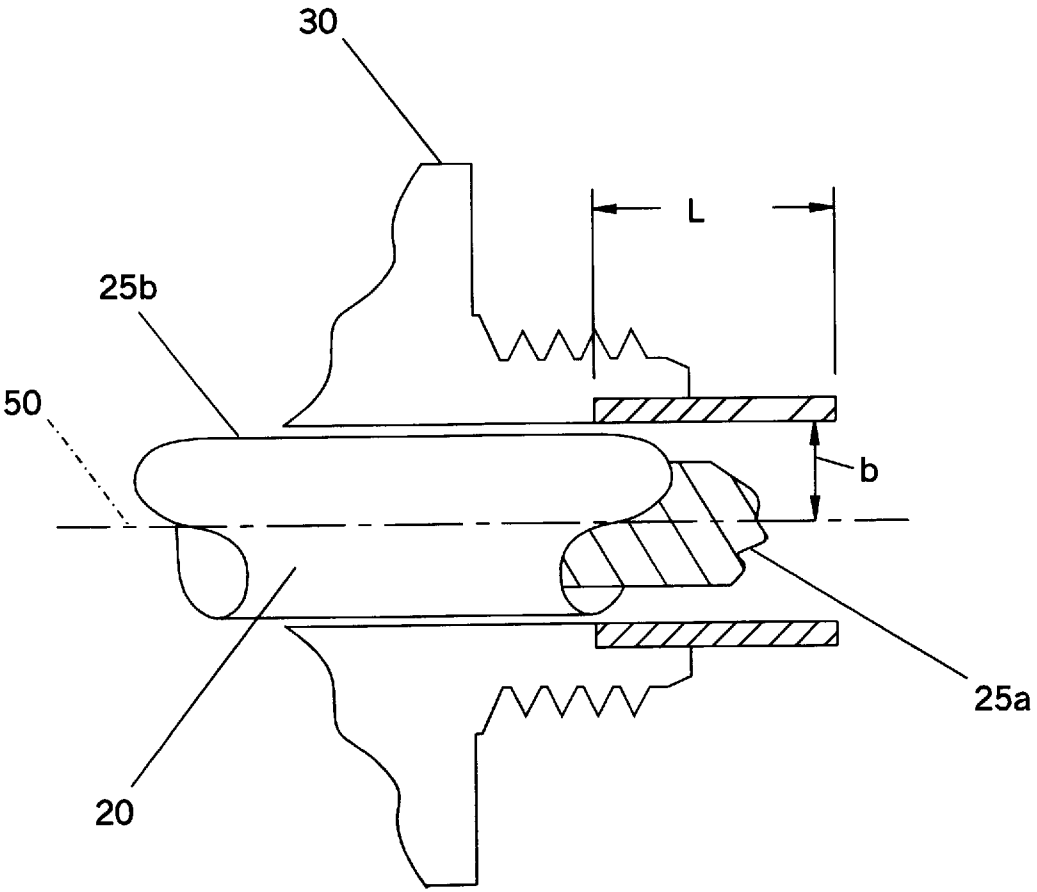
FIG. 7 is a diagram of the spatial relationship between the configuration of the antenna and the contact ferrule (or cylindrical conductor) and corresponding equation parameters (L, b, a) used for capacitive calculations according to the present invention.

FIGS. 7 and 7A illustrate geometrical and electrical relationships which can be used to determine a configuration of the contact ferrule and antenna rod to yield a desired capacitance. For example, a preferred capacitance value is about three (3) picofarads (pF) for an 800 Mhz band radiotelephone. Conventionally, one option to adjust this value was to adjust the antenna length. Unfortunately, such an adjustment can impact (narrow) the operational bandwidth of the radiotelephone. Preferably, varying the geometric parameters listed in Equation 1, a desired capacitance can be determined according to:

$$C=2\pi\epsilon L/(1n(b/a)) \qquad \text{Equation 1}$$

In this equation, "ϵ" is the dielectric constant of the material used over the antenna core (for example, a DELRIN extrusion over a NiTi rod); "L" is the longitudinal length of the contact ferrule 40; "a" is the radius of the antenna core 25*a*; and "b" is the inner radius of the contact ferrule 40. Preferably, the outer surface of the rod 25*b* is concentric with the core 25*a* . Typically, the outer surface material is extruded or bonded and fused to the core 25*a* . Using DELRIN, an exemplary ferrule length is about 11.5 mm. As will be understood by one of skill in the art, for a specified capacitance value, the length of the ferrule (L) needed is affected by the strength of the dielectric constant of the outer surface material of the antenna rod. Nylon and similar materials typically have relative dielectric constants about 3.7 with TEFLON at about 2.1.

Figure 8:
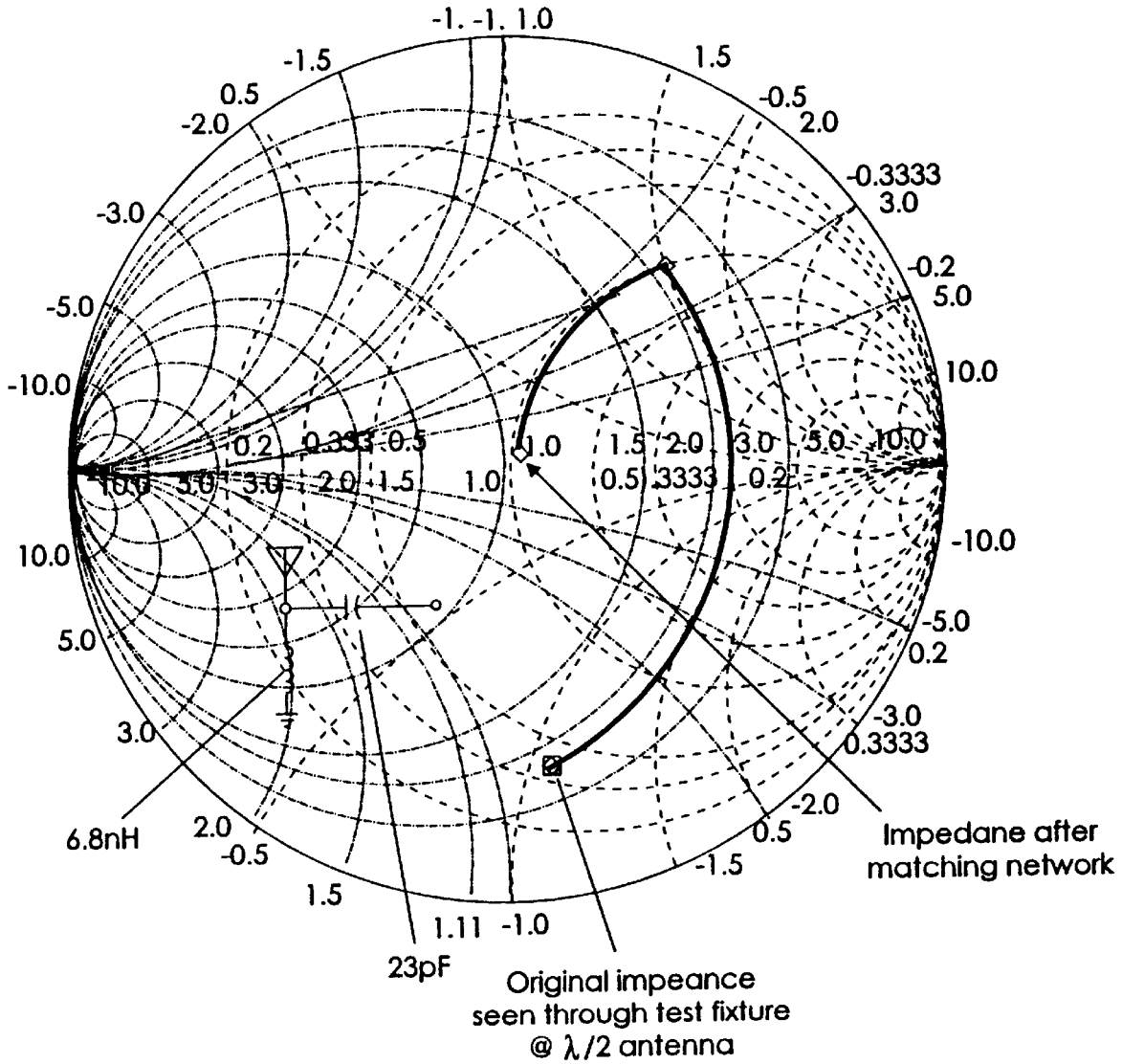
FIG. 8 is a graphical representation of test data graphed on complex impedance plots illustrating impedances associated with a matching system according to the present invention and an original impedance as seen through a test fixture.

FIG. 8 illustrates test data generated on a complex impedance plot, showing the original impedance and the impedance after matching. Advantageously, the data shows that the shunt inductor does not degrade gain performance, and indicates only slight changes in the impedance measured looking into the antenna.

As used herein, the term "printed circuit board" is meant to include any microelectronics packaging substrate.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clause are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An antenna assembly, comprising:

a cylindrical antenna having a conductive core and an outer surface and including opposing first and second ends defining a central axis through the center thereof, said antenna including upper and lower contacts in electrical communication with said core and positioned on the outer surface of said antenna; and a non-conductive base unit having top and bottom ends and including an aperture therethrough, said aperture configured to receive portions of said antenna therein, said base unit including a conductive ferrule fixedly attached to and extending from the bottom of said base unit;

wherein said antenna retracts and extends in and out of said base unit such that when said antenna is retracted said antenna upper contact electrically contacts said ferrule, and when said antenna is extended said ferrule and said antenna define a capacitor therebetween.

2. An antenna assembly according to claim 1, wherein said base unit aperture extends along the central axis of said antenna and said antenna translates in and out of said base unit along the central axis, and wherein said ferrule is a cylindrical conductor.

3. An antenna assembly according to claim 1, wherein said antenna outer surface adjacent said lower contact includes an insulating barrier.

4. An antenna assembly according to claim 1, in combination with a radiotelephone, said radiotelephone including an internally disposed printed circuit board and an antenna connector affixed to said printed circuit board, said antenna connector including separate shunt and signal contacts thereon, wherein said ferrule engages with said signal contact to provide a single signal feedpoint to transmit and receive an RF signal to and from said antenna and said radiotelephone.

5. An antenna assembly according to claim 4, wherein said antenna, said ferrule, and said antenna connector define first and second signal paths, wherein said first signal path is operative when said antenna is extended and said second signal path is operative when said antenna is retracted.

6. An antenna assembly according to claim 5, wherein said first signal path is configured to provide an L-C matching circuit having capacitive and inductive components, said capacitive component defined by said antenna and said ferrule, and said inductive component activated when said antenna lower contact engages with said antenna connector shunt contact.

7. An antenna assembly according to claim 1, wherein said antenna includes in longitudinal serial order, a top loaded antenna element with a first outer diameter, a stepped down portion with a second outer diameter, and a linear rod element with a third outer diameter having said upper contact therearound, and wherein said base is configured to receive said stepped down portion and said upper contact therein when said antenna is in a fully retracted position.

8. An antenna assembly according to claim 7, wherein said antenna and said base are mechanically secured in tight abutment in the fully retracted position.

9. An antenna assembly according to claim 1, wherein said capacitor is about a 3pF coaxial capacitor.

10. An antenna assembly according to claim 1, wherein the capacitance value of said capacitor corresponds to the radial width of said core, and the length and radial width of said cylindrical contact.

11. An antenna assembly according to claim 10, wherein said capacitance is calculated by the equation, $$C=2\pi\epsilon L/(1n(b/a)).$$

12. A radiotelephone with a matching system comprising:

a radiotelephone housing;

a printed circuit board disposed in said housing;

an antenna connector secured to said housing, said antenna connector comprising first and second contacts;

an antenna base having an opening therein attached to said radiotelephone housing, said antenna base including a portion which extends out of said radiotelephone and a portion which is contained within said radiotelephone, said portion which is contained within said housing including a contact ferrule thereon; and a longitudinally extending antenna adapted to be received in said antenna base opening such that said antenna is free to retract and extend relative thereto, said antenna including upper and lower electrical contacts, wherein when said antenna is retracted said upper contact electrically communicates with said contact ferrule and said first antenna connector contact to define a first signal path, and when said antenna is extended said lower contact is spaced apart from said contact ferrule and said lower contact and said contact ferrule electrically communicate with a respective one of said second contact and said first contact to provide a matching L-C circuit, and wherein said capacitor in said L-C circuit is defined by said contact ferrule and said antenna.

13. A radiotelephone according to claim 12, wherein said antenna base includes a non-conducting threaded portion for attachment to said radiotelephone housing.

14. A radiotelephone according to claim 12, wherein said antenna base is non-conductive and said contact ferrule is affixed to the inner diameter of said threaded portion.

15. A radiotelephone according to claim 12, wherein said antenna outer surface adjacent said lower contact radially extends a further distance than a majority of the antenna outer surface.

16. A radiotelephone according to claim 15, said first and second antenna connector contacts comprising separate shunt and signal contacts, wherein said contact ferrule engages with said signal contact to provide a single feedpoint to transmit and receive an RF signal to and from said antenna and said radiotelephone.

17. A radiotelephone according to claim 16, wherein said L-C circuit includes capacitive and inductive components such that said inductive component is in series with said shunt contact and is activated when said antenna lower contact engages with said antenna connector ground contact.

18. A radiotelephone according to claim 17, wherein said antenna includes in longitudinal serial order, a top loaded antenna element with a first outer diameter, a stepped down portion with a second outer diameter, and a linear rod element with a third outer diameter having said upper contact therearound, and wherein said base is configured to receive said stepped down portion and said upper contact therein when said antenna is in a fully retracted position.

19. A radiotelephone according to claim 18, wherein said antenna and said base are mechanically secured in tight abutment in the fully retracted position.

20. A radiotelephone according to claim 12, wherein said capacitor is about a 3pF coaxial capacitor.

21. A radiotelephone according to claim 12, wherein said antenna is a cylindrical antenna having a core radius and an outer surface radius and said contact ferrule is a cylindrical ferrule having a length and a radial width, and wherein the capacitance value of said capacitor corresponds to the radial width of said core, and the length and radial width of said contact ferrule.

22. A radiotelephone according to claim 21, wherein said capacitance is calculated by the equation, $$C=2\pi\epsilon L/(1n(b/a)).$$

23. A matching system for a radiotelephone with a retractable antenna, comprising:

a cylindrical antenna having a conductive core and an outer surface and including opposing first and second ends defining a central axis through the center thereof, said antenna including upper and lower contacts in electrical communication with said core; and a non-conductive base unit having top and bottom ends and including an aperture therethrough, said aperture configured to receive portions of said antenna therein, said base unit including a conductive ferrule fixedly attached to, and extending from, the bottom of said base unit;

wherein said antenna retracts and extends in and out of said base unit such that when said antenna is retracted said antenna upper contact electrically contacts said ferrule, and when said antenna is extended a capacitive element for a matching circuit is activated by electrical communication between and mechanical configuration of said ferrule and said antenna.

24. A matching system according to claim 23, wherein said radiotelephone includes an internally disposed printed circuit board and an antenna connector affixed to said printed circuit board, said antenna connector including separate ground and signal contacts thereon, wherein said ferrule engages with said signal contact to provide a single signal feedpoint to transmit and receive an RF signal to and from said antenna and said radiotelephone.

25. A matching system according to claim 24, wherein said antenna, said ferrule, and said antenna connector define first and second signal paths, wherein said first signal path is operative when said antenna is extended and said second signal path is operative when said antenna is retracted.

26. A matching system according to claim 25, wherein said first signal path is configured to provide an L-C matching circuit having capacitive and inductive components, wherein at least part of said capacitive component defined by said antenna and said ferrule conductor, and wherein said inductive component is activated when said antenna lower contact engages with said antenna connector shunt contact.

* * * * *